United States Patent [19]

Vance

[11] 4,087,077

[45] May 2, 1978

[54] LOG LIFTER

[75] Inventor: Charles E. Vance, Thetford Center, Vt.

[73] Assignee: Mildred B. Vance, Thetford Center, Vt. ; a part interest

[21] Appl. No.: 789,672

[22] Filed: Apr. 21, 1977

[51] Int. Cl.[2] ..... B66F 7/22

[52] U.S. Cl. ..... 254/94; 294/17

[58] Field of Search ..... 254/94, 131; 294/17; 248/346

[56] References Cited

U.S. PATENT DOCUMENTS 1,635,291 7/1927 Smith et al. ..... 254/94

2,733,895 2/1956 Trenkle ..... 254/131

*Primary Examiner*—Robert C. Watson

*Attorney, Agent, or Firm*—Clarence A. OBrien; Harvey B. Jacobson

[57] ABSTRACT

A log lifter has a support assembly engageable with an article, such as a log, to be lifted for elevating the article from a support surface with the assistance of a manipulating handle attached to the support assembly. Pivotally mounted on the handle is a hook which cooperates with a spike and a point mounted in juxtaposition on the support assembly to retain a log or other article on the log lifter.

6 Claims, 5 Drawing Figures

LOG LIFTER

BACKGROUND OF THE INVENTION

1. Field of the Invention

This invention relates generally to a device for lifting logs and similar articles, and particularly to a lifting device of the class generally referred to as cant dogs or peaveys, and cant hooks.

2. Description of the Prior Art

Various tools have been proposed under the general designation of log jacks for lifting a log, and the like, off of the ground or other supporting surface in order to facilitate sawing or chopping of the log. U.S. Pat. Nos. 2,539,231, issued Jan. 23, 1951, to N. J. Davis, and U.S. Pat. No. 2,718,375, issued Sept. 20, 1955, to O. G. Purdy, disclose such devices based on the conventional logging tools known as cant hooks, while U.S. Pat. No. 2,733,895, issued Feb. 7, 1956, to J. I. Trenkle, discloses a timber or logging jack similar to the well known cant dog or peavey. These known devices, however, as well as the log lifter and holder disclosed in U.S. Pat. No. 1,829,490, issued Oct. 27, 1931, to W. B. Parrish, use a portion of the handle of the device to support the load which has been lifted. This load on the handle severely limits the amount of load which can be handled by the device.

U.S. Pat. No. 2,693,935, issued Nov. 9, 1954, to E. J. Halbert, discloses a log jack wherein a work engaging portion is slipped substantially under the log or other load to be lifted prior to swinging the device around a fulcrum so as to lift the log off of the supporting surface. However, this known device must be employed on fairly level ground in order to obtain the necessary insertion of the work engaging portion under the log and to prevent the handle of the device from supporting a substantial portion of the weight of an article lifted by the device.

U.S. Pat. No. 244,870, issued July 26, 1881, to C. H. Fasig, discloses a log turner which employs a hook arranged for engaging a log or similar article in the lower portion thereof in order to impart a rotational movement to the log that will turn the log over as desired.

SUMMARY OF THE INVENTION

It is an object of the present invention to provide a log lifting device of simple, yet rugged and reliable, construction which will lift a log, or like articles, off of a support without requiring a handle of the device to partially support the log.

It is another object of the present invention to provide a support assembly which may be used in conjunction with a standard cant dog or cant hook of conventional construction to form a log lifter according to the present invention.

It is yet another object of the present invention to provide a support assembly for a log lifter which will increase the bearing area of a cant dog or cant hook employed with the support assembly during pivotal movement of the lifter in order to elevate an article from an associated support surface, while preventing a handle of the cant hook or cant dog from supporting the weight of the article so elevated.

These and other objects are achieved according to the present invention by providing a log lifter having: a support assembly engageable with an article to be lifted for elevating the article from a support surface associated with the article; a manipulating handle attached to the support assembly; and a retaining arrangement mounted on the support assembly and on the handle for selectively engaging and holding the article to be lifted on the support assembly.

The support assembly according to the invention preferably includes a L-shaped bracket having a pair of substantially perpendicularly extending legs, one of which legs is attached to a base member disposed extending transversely of the extent of the attached one of the legs. A stand element is mounted on the base member and arranged extending from the base member codirectionally with and substantially parallel to the other of the legs of the bracket, with a socket-forming member being mounted on and disposed extending between the other of the legs of the bracket and the support element for receiving a manipulating handle, which handle is advantageously a portion of a conventional cant dog or cant hook.

The socket-forming assembly advantageously comprises a longitudinally extending trough of substantially circular cross section and having an open top, with a circumference of the trough being smaller adjacent the stand element than adjacent the other of the legs of the bracket.

The retaining arrangement is partially formed by the hook conventionally pivotally mounted on the handle of the cant dog or cant hook received by the socket-forming member, and partially by a spike mounted on the support arrangement adjacent the support element and arranged for cooperating with the hook to retain an article on the log lifter. The retaining arrangement also advantageously further includes a point formed on the stand element adjacent the socket arrangement and arranged extending codirectionally with the spike and with the other of the legs of the bracket, with the point selectively cooperating with a spike and the hook of the cant dog or cant hook to retain an article on the log lifter.

The base member preferably includes a planar portion attached to the one of the legs of the bracket, and also a flange arranged coplanar with and extending away from the stand element. The support assembly further includes a rectangular bearing member connected to the base member and disposed abutting the flange for increasing the bearing area of the support assembly on an associated support surface so as to permit the log lifter according to the invention to be used on snow, muddy soil, and other soft supporting surfaces.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 5:
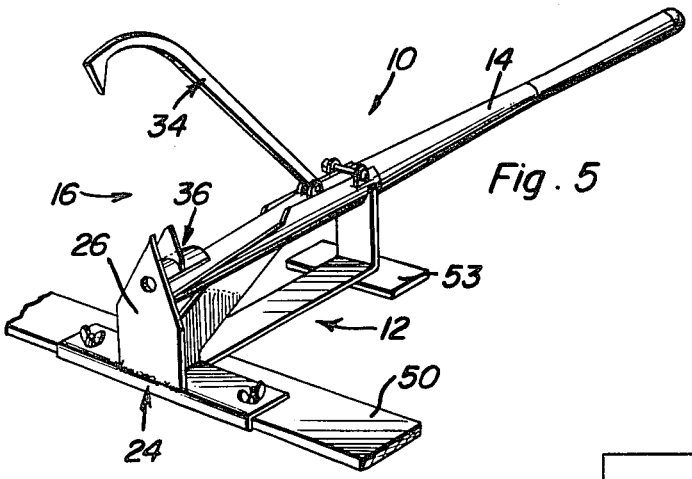
FIG. 5 is a perspective view showing the log lifter of FIGS. 1 through 4.
Figure 1:
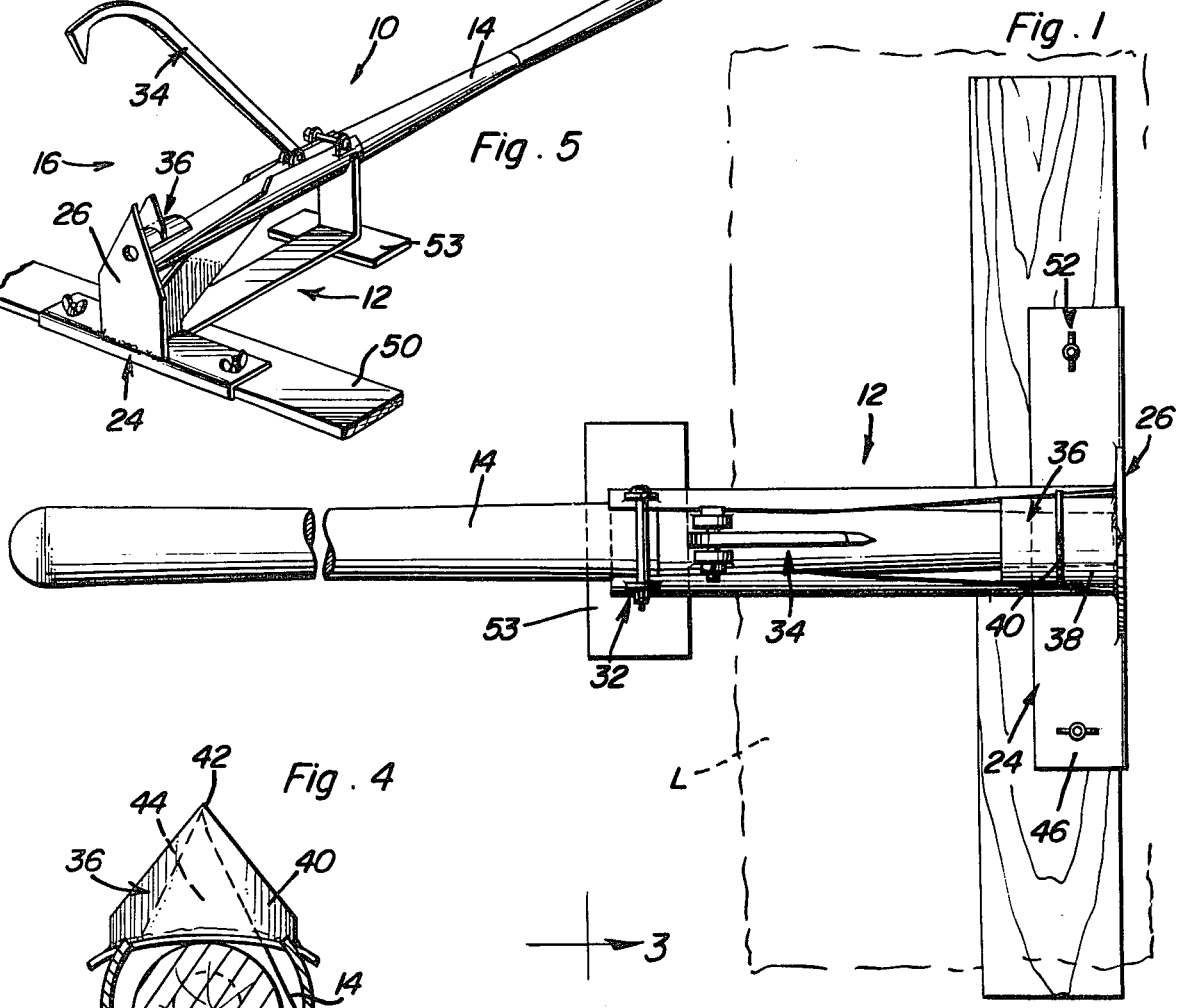
FIG. 1 is a fragmentary, top plan view showing a log lifter according to the present invention.
Figure 4:
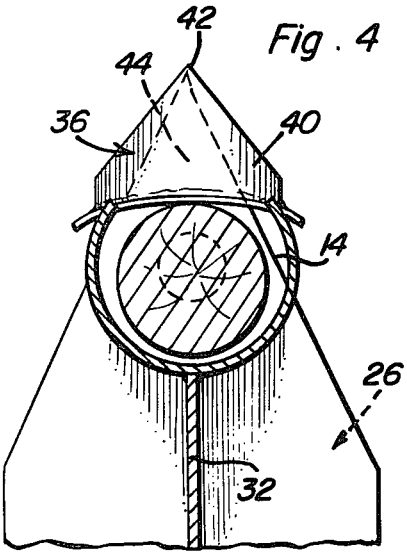
FIG. 4 is a fragmentary, sectional view taken generally along the line 4—4 of FIG. 3.
Figure 2:
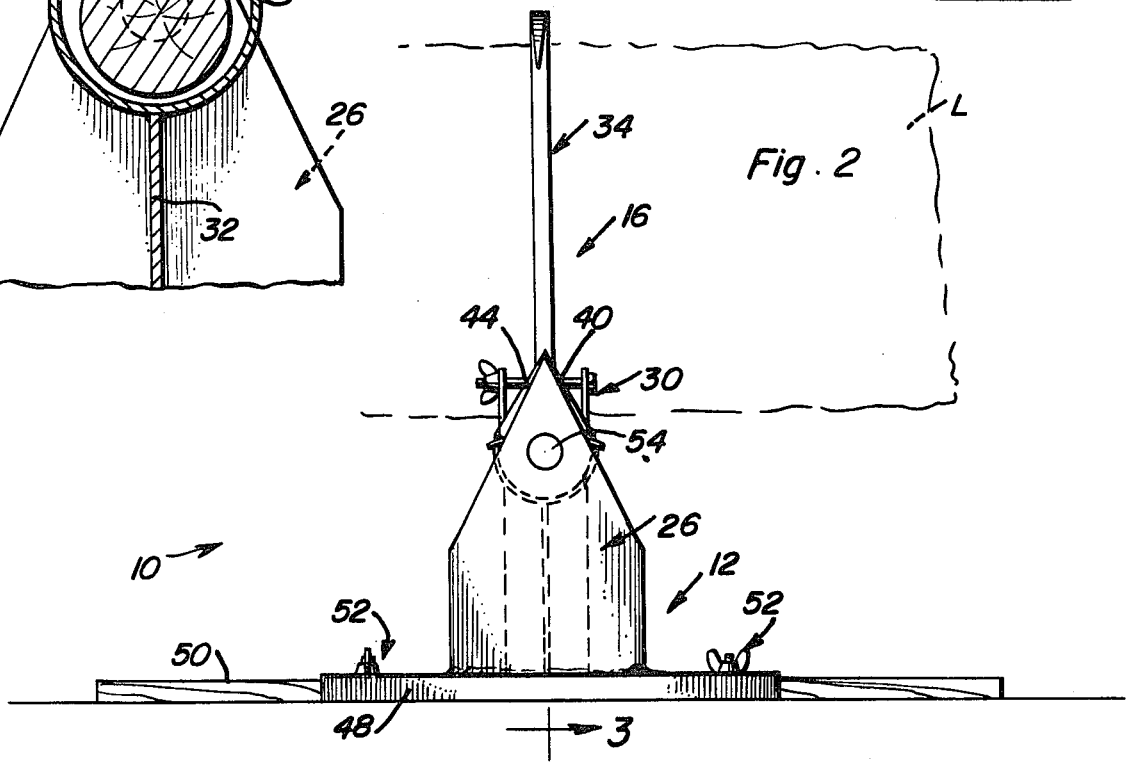
FIG. 2 is a front elevational view as seen from the right in FIG. 1.
Figure 3:
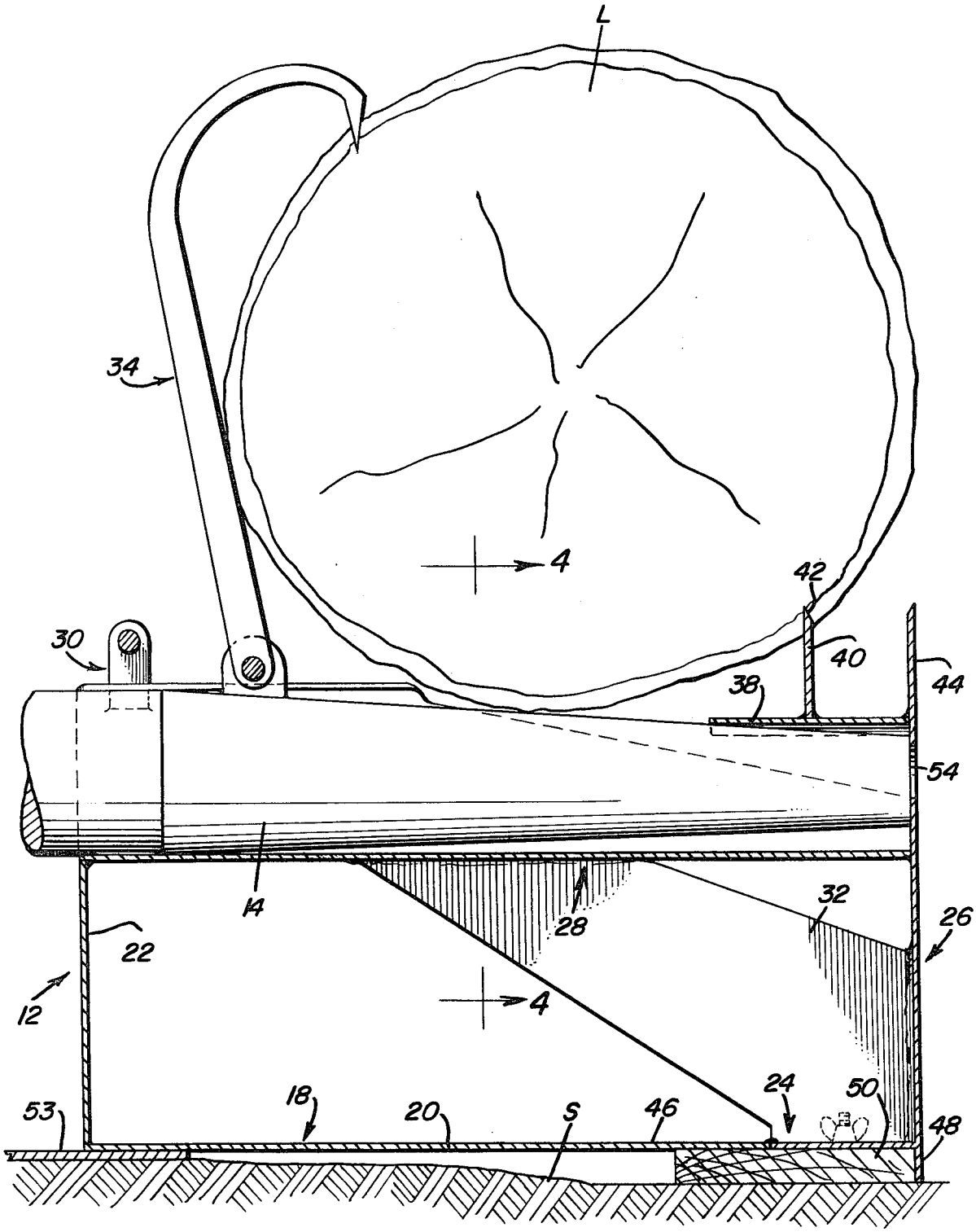
FIG. 3 is an enlarged, fragmentary, sectional view taken generally along the line 3—3 of FIG. 2, but showing a log being retained on the lifter.

Referring now more particularly to the figures of the drawings, the log lifter 10 according to the present invention includes a support assembly 12 engageable with an article, such as a log L to be lifted, for elevating the article from a support surface S, such as the surface of earth on which the log is resting. A manipulating handle 14 of a conventional cant hook is illustrated as attached to the support assembly 12 as by insertion into a socket formed in assembly 12, and log L is retained on log lifter 10 by a retaining arrangement 16 which includes the hook of the cant hook partially formed by handle 14 and tooth elements mounted on support assembly 12, in a manner to be described below, selectively engages and holds the article on the support assembly 12.

Support assembly 12 includes a L-shaped bracket 18 having a pair of substantially perpendicularly extending legs 20 and 22, and a base member 24 attached to leg 20 and disposed extending transversely of the longitudinal extent of the associated leg 20. A stand element 26 is mounted on base member 24 and arranged extending from base member 24 codirectionally with and substantially parallel to leg 22 of bracket 18. A socket-forming member 28 is mounted on and extends between leg 22 and stand element 26 for receiving the tapered fulcrum end of handle 14 so as to form the attachment between handle 14 and support assembly 12.

Socket-forming member 28 comprises a trough of substantially circular cross section having an open top and a circumference smaller adjacent the stand element 26 than adjacent the leg 22 of bracket 18. Handle 14 is retained within this trough of member 28 as by a conventional clamp 30, with the member 28 itself being rigidified relative to bracket 18 as by the illustrated brace 32 extending between the bottom of member 28 and base member 24. By the provision of an open top in member 28, the hook 34 pivotally mounted on handle 14 as is conventional for a cant hook can pivot toward and away from the support assembly 12 and cooperate with a spike 36 mounted on support assembly 12, or more specifically on member 28 adjacent stand element 26 so as to retain a log L or other article on log lifter 10.

Spike 36 includes a curved anchor element 38 mounted in suitable recesses provided in the upper edges of member 28 adjacent stand element 26 so as to support a plate 40 forming a tip 42 and extending away from anchor element 38 and member 28 and toward the hook 34.

Retaining arrangement 16 further includes a point 44 formed on the uppermost portion of stand element 26 adjacent the socket-forming member 28 and arranged extending codirectionally and coextensive with plate 40 of spike 36 and with leg 22 of bracket 18 so as to selectively cooperate with plate 40 of spike 36 and hook 34 to retain a log L or other suitable article.

Base member 24 includes a planar portion 46 attached to leg 20 of bracket 18 so as to extend longitudinally transversely of the extent of leg 20, and a flange 48 arranged coplanar with and extending away from the stand element 26. The support assembly 12 further includes a rectangular bearing member in the form of a board 50 connected to the planar portion 46 of base member 24 as by the illustrated bolts and wing nut fasteners 52, and is disposed abutting the flange 48 and the undersurface of planar portion 46. The purpose of board 50 is to increase the bearing area of support assembly 12 on an associated support surface and thus permit log lifter 10 to be used on soft surfaces, such as snow, mud, and the like.

While the support assembly 12 is generally constructed from a suitable steel, board 50 is preferably formed of kiln dried hardwood of any size convenient to one using a support assembly according to the invention.

A heel plate 53 is shown disposed affixed to planar portion 46 adjacent and extending rearwardly of leg 22 for increasing the bearing surface of bracket 18 in mud, snow, and the like.

An aperture 54 is advantageously provided in stand element 26 so as to communicate with the interior of the trough of member 28 at the fulcrum end of the handle of the cant hook or cant dog used in conjunction with a support assembly according to to the invention. Provision of aperture 54 will permit a cant dog (not shown) provided with a spike extending from the end of its associated handle in a conventional manner to be used with a support assembly by allowing the spike to pass through stand element 26.

In operation, a log lifter according to the present invention is placed in, for example, the middle of a log L and the handle thereof pulled back so as to lift log L entirely off the support surface S. The barb portion of hook 34 and at least the spike 40, if not also the point 44, will sink into the log L because of the log's weight and prevent the log from rolling back as the elevating operation is performed. More specifically, the handle of the device will be substantially vertical as the log is engaged, and the board 50 will be supporting the log L on the support surface S after the device has been rotated, log L turning about its longitudinal axis substantially 90°, so that the handle of the cant hook or cant dog is substantially horizontal, depending upon the slope of support surface S.

As can be readily understood from the above description and from the drawings, a log lifter including a support assembly according to the present invention permits a conventional cant dog or cant hook to be employed in a more efficient manner, requiring less strength and without any portion of the weight of the log or other article lifted being exerted on the handle while various cutting or similar operations are performed on the log. Generally, a log lifter constructed according to the invention need be positioned only once to completely cut the log into, for example, stove or fireplace wood, and seldom needs to be positioned more than twice for such cutting operations to be fully performed.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A support assembly for use with a conventional log jack including a handle and a hook pivotally mounted on the handle for facilitating the lifting of logs, and the like, comprising, in combination:

(a) an L-shaped bracket having a pair of substantially perpendicularly extending legs;
(b) a stand element mounted on one of the legs of the bracket and arranged extending from the one of the legs codirectionally with and substantially parallel to the other of the legs of the bracket;
(c) socket means mounted on and extending between the other of the legs of the bracket and the stand element for receiving a handle of a log jack; and
(d) retaining means for selectively engaging and holding an article on the support assembly in cooperation with a hook pivotally mounted on the handle of the log jack, the retaining means comprising, in combination:
(1) a spike mounted on the socket means adjacent the stand element and arranged for cooperating with the hook of the log jack for retaining an article; and
(2) a point formed on the stand element adjacent the socket means and arranged extending codirectionally with the spike and with the other of the legs of the bracket, the point selectively cooperating with the spike, and with the hook, to retain an article on the support assembly.

2. Apparatus, comprising, in combination:
(a) support means engageable with an article to be lifted for elevating the article from a support surface;
(b) a manipulating handle attached to the support means; and
(c) retaining means mounted on the support means for selectively engaging and holding the article on the support means, the support means including, in combination:
(1) an L-shaped bracket having a pair of substantially perpendicularly extending legs;
(2) a base member attached to and disposed extending transversely of one of the legs of the bracket;
(3) a stand element mounted on the base member and arranged extending from the base member codirectionally with and substantially parallel to the other of the legs of the bracket;
(4) socket means mounted on and disposed extending between the other of the legs of the bracket and the stand element for receiving the manipulating handle, the socket means comprising a trough of substantially circular cross section, having an open top, and a circumference smaller adjacent the stand element than adjacent the other of the legs of the bracket; the retaining means including, in combination:
(5) a hook pivotally mounted on the manipulating handle adjacent the other of the legs of the bracket for movement toward and away from the trough and extending toward the stand element; and
(6) a spike mounted on the socket means adjacent the stand element and arranged for cooperating with the hook to retain an article on the support means.

3. A structure as defined in claim 2, wherein the retaining means further includes:
(7) a point formed on the stand element adjacent the socket means and arranged extending codirectionally with the spike and with the other of the legs of the bracket, the point selectively cooperating with the spike and with the hook to retain an article on the support means.

4. A structure as defined in claim 3, wherein the base member includes a planar portion attached to the one of the legs of the bracket, with the support means further including a rectangular bearing member having a surface of substantially larger dimensions than the planar portion of the base member and connected to the planar portion with the surface abutting the planar portion of the base member for increasing the bearing area of the support means on an associated supporting surface.

5. A structure as defined in claim 2, wherein the base member includes a planar portion attached to the one of the legs of the bracket, with the support means further including a rectangular bearing member having a surface of substantially larger dimensions than the planar portion of the base member and connected to the planar portion with the surface abutting the planar portion of the base member for increasing the bearing area of the support means on an associated supporting surface.

6. A support assembly for use with a conventional log jack including a handle and a hook pivotally mounted on the handle for facilitating the lifting of logs, and the like, comprising, in combination:
(a) an L-shaped bracket having a pair of substantially perpendicularly extending legs;
(b) a base member attached to and disposed extending transversely of one of the legs of the bracket;
(c) a stand element mounted on the base member and arranged extending from the base member codirectionally with and substantially parallel to the other of the legs of the bracket;
(d) socket means mounted on and extending between the other of the legs of the bracket and the stand element for receiving a handle of a log jack, the socket means comprising a trough of substantially circular cross section, having an open top, and a circumference smaller adjacent the stand element than adjacent the other of the legs of the bracket;
(e) retaining means for selectively engaging and holding an article on the support assembly in cooperation with a hook pivotally mounted on the handle of the log jack, the retaining means comprising, in combination:
(1) a spike mounted on the socket means adjacent the stand element and arranged for cooperating with the hook of the log jack for retaining an article; and
(2) a point formed on the stand element adjacent the socket means and arranged extending codirectionally with the spike and with the other of the legs of the bracket, the point selectively cooperating with the spike, and with the hook, to retain an article on the support assembly.

* * * * *